US005369267A

United States Patent [19]

Johnson et al.

[11] Patent Number: 5,369,267

[45] Date of Patent: Nov. 29, 1994

[54] MICROCHANNEL IMAGE INTENSIFIER TUBE WITH NOVEL SEALING FEATURE

[75] Inventors: David B. Johnson; Allan W. Scott, both of Santa Clara County; Stephen J. Bartz, San Mateo County, all of Calif.

[73] Assignee: Intevac, Inc., Santa Clara, Calif.

[21] Appl. No.: 63,234

[22] Filed: May 18, 1993

[51] Int. Cl.[5] ..... H01J 40/14

[52] U.S. Cl. ..... 250/214 VT; 313/365

[58] Field of Search ..... 250/214 VT; 313/103 CM, 313/105 CM, 365, 524, 528; 445/45, 43

[56] References Cited

U.S. PATENT DOCUMENTS

| | | | |
|---|---|---|---|
| 3,853,374 | 12/1974 | Flasche et al. | 445/43 |
| 4,052,115 | 10/1977 | Jean | 445/70 |
| 4,153,316 | 5/1979 | Houtkamp | 445/43 |
| 4,295,073 | 10/1981 | Freeman et al. | 313/105 CM |

*Primary Examiner*—David C. Nelms
*Assistant Examiner*—Stephone B. Allen
*Attorney, Agent, or Firm*—Stanley Z. Cole

[57] ABSTRACT

A low cost image intensifier tube is provided which has an improved vacuum sealing mechanism and improved optical transmission. Glass windows on both the input and output of the tube are vacuum sealed within the housing by a ring of indium that contacts the interface between each of the windows and the housing. A pair of raised pointed flanges each positioned along the inner housing surface interfacing the windows protrude into the adjacent ring of indium for improving the vacuum seal of both input and output windows and for controlling the spacing of the elements within the tube. Sealing the photocathode from the rest of the tube is a ceramic cathode cork. The cathode cork is a solid sealing ring press fit within the tube housing and colocated between the input window at the outer edge of the photocathode and the microchannel plate.

19 Claims, 2 Drawing Sheets

MICROCHANNEL IMAGE INTENSIFIER TUBE WITH NOVEL SEALING FEATURE

BACKGROUND OF THE INVENTION

The present invention relates generally to optical imaging devices, and more particularly to a novel optical image intensifier tube.

Image intensifier tubes (also called image enhancement tubes or simply image tubes) were first developed in the mid to late 1930's for military night vision applications. The early electro-optical low-light amplifiers were image converter infra-red tubes, also known as Gen O and Gen I night amplifier tubes. These were used successfully for many years. A successor to these tubes was the microchannel intensifier. It was a great improvement in size, cost and performance. A microchannel intensifier tube basically consists of a photosensitive cathode, a microchannel plate (MCP), and a phosphor output screen. The photocathode converts incoming photons representing an image to a corresponding stream of electrons. The electrons are accelerated to an MCP which intensifies the flow of electrons. At the output of the MCP the intensified electrons are accelerated again by another strong electric field to strike the luminescent phosphor screen whereat an enhanced visible image is created. The MCP consists of a two-dimensional array of miniature microchannel multipliers. A good background description of the microchannel image intensifier and the fabrication of microchannel plates can be found in "The Microchannel Image Intensifier," *The Scientific American*, Vol. 245 (November 1981) pp. 46–55 by Michael Lampton.

Microchannel image intensifiers are frequently employed today in applications requiring high amplification of extremely low-light levels. One obvious advantage of the current generation of microchannel image intensifiers is their light sensitivity obviating the need for auxiliary irradiation either in the visible or near-infrared spectrum. They are particularly suited to night-time surveillance in military or police applications since they have high luminous gain, high image resolution and excellent low light sensitivity. In addition the Gen III tubes are particularly sensitive in the near-infrared (NIR) spectrum, which makes them useful in surveillance since night sky radiation is particularly high in the non-visible NIR region.

This invention is directed to an intensifier tube design that reduces costs for such tubes and improves lifetime and reliability.

Another general object of the invention is to provide a low cost image intensifier tube design that greatly reduces major sources of gas leaks in prior art tubes and greatly extends the shelf life of the intensifier tube resulting in lower system maintenance costs in connection with systems employing such tubes.

SUMMARY OF THE INVENTION

In accordance with the teachings of the present invention, these and other objectives are achieved through a novel image intensifier tube design having an improved vacuum sealing mechanism and improved optical transmission. A solid glass window is advantageously used on both the input and output of the tube for improved optical transmission and for improved vacuum integrity. The glass windows also reduce the tube size and weight. To help seal the photocathode which is bonded to the inner surface of the input window, a "cathode cork" is provided. A cathode cork is a solid sealing ring press fit within the tube housing and colocated between the input window at the outer edge of the photocathode and the microchannel plate. In addition both input and output windows are vacuum sealed within the housing in a novel manner by a ring of indium that contacts the interface between each of the windows and the housing. The housing advantageously has a pair of raised pointed flanges, each positioned along the inner housing surface interfacing the windows, and positioned to protrude into the adjacent ring of indium for improving the vacuum seal of both input and output windows.

BRIEF DESCRIPTION OF THE DRAWINGS

A better understanding of the invention may be had from a consideration of the following detailed description, taken in conjunction with the accompanying drawings in which.

DETAILED DESCRIPTION

Figure 1:
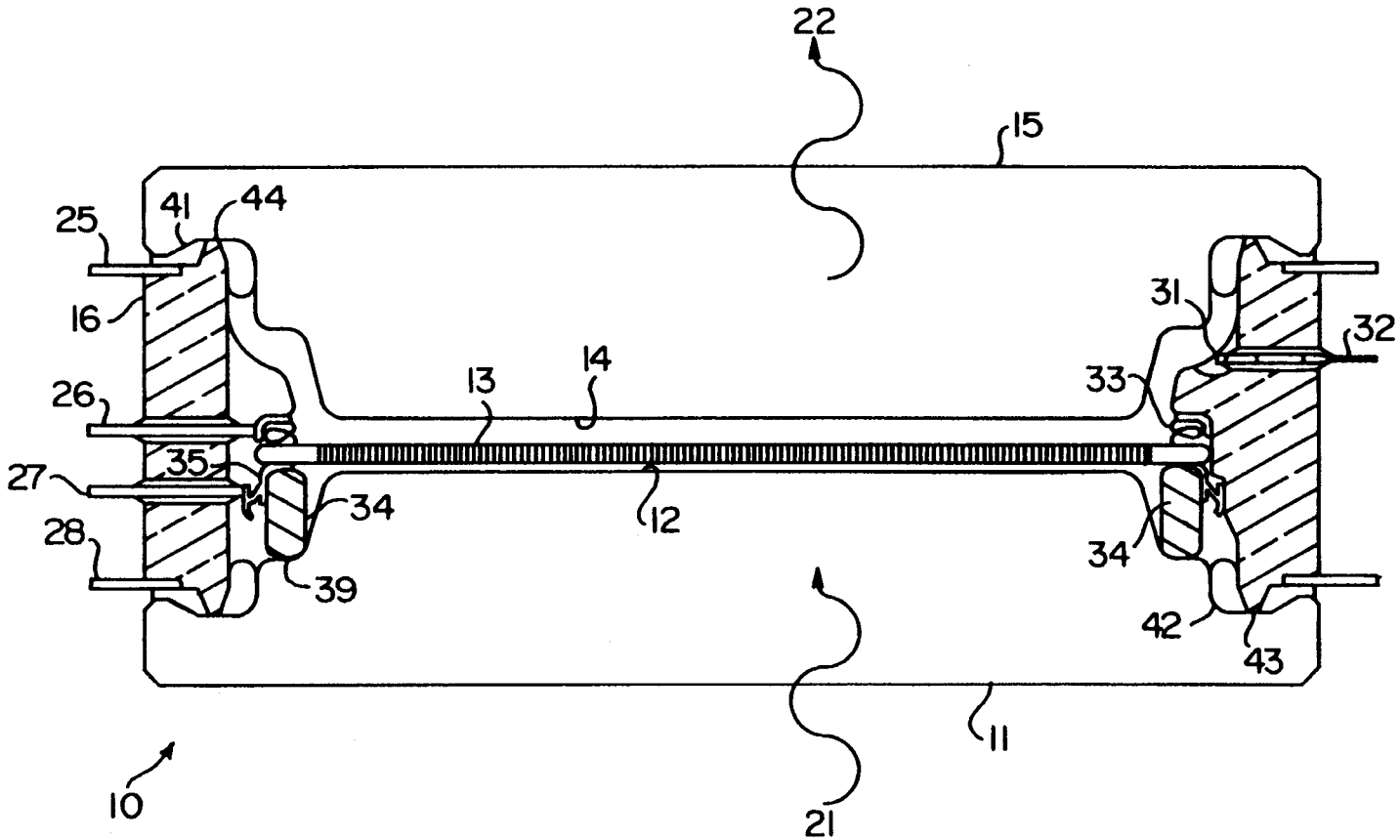
FIG. 1 is an enlarged cross-sectional diagram representation of an image intensifier tube in accordance with the invention.

Referring now to FIG. 1, the cross section of an image intensifier tube 10 is depicted in accordance with one aspect of the invention and includes: an input glass window 11, a photocathode 12 bonded to the surface of the input window, a microchannel plate 13 spaced apart from the photocathode, a phosphor screen 14 bonded to a glass output window 15 on its inner surface adjacent to the microchannel plate 13. Glass windows 11 and 15 also act as faceplates of the tubular housing 16 sealing the interior components 12, 13 and 14 within a vacuum. Housing 16 is preferably a solid ceramic body although glass or other insulator materials can be used. Photocathode 12 may optionally be vacuum deposited onto the surface of input window 11.

All of the numerical dimensions and values that follow should be taken as nominal values rather than absolutes or as a limitation on the scope of the invention. These nominal values are given as examples only. Variations in size, shape and types of materials will readily occur to those skilled in the art and may be used as successfully as the values, dimensions and types of materials specifically provided hereinafter. In this regard where ranges are provided these should be understood as guides to the practice of this invention.

Operationally, light 21 enters through window 11 passing to photocathode 12 which converts the incoming light 21 to a corresponding stream of photoelectrons. The photoelectrons are accelerated across the nominal 0.01" (0.254 mm) (0.003" to 0.015") photocathode-to-MCP gap by a potential difference of several hundred volts to strike MCP 13 in a spatial relationship conforming to the incoming light image. The input side of MCP 13 is typically at ground potential by a connection to electrode 27. However, any of the electrodes could be grounded with a corresponding adjustment of the potentials at the other electrodes. The MCP amplifies and accelerates the electrons entering to form an amplified electron image at the output side of the MCP. A potential difference of several hundred volts, −800 V (400 V to 1200 V) is maintained across MCP 13 to accelerate the electrons passing through. The output voltage on electrode 26 sets the voltage across MCP 13 and is the principal gain control mechanism of the tube. The exiting electrons are again accelerated across the −0.028" (0.711 mm) (0.01" to 0.05") MCP-to-phosphor screen gap by a potential difference of several thousand volts (−4800 V) (+3000 V to +9000 V) where they strike the phosphor screen 14. Phosphor screen 14 converts the impinging electrons to a light image that can be seen through the glass output window 15 as a coherent optical image 22.

Glass windows 11 and 15 are preferable made of −0.22" (5.59 mm) (0.1" to 0.4") Corning Glass Company 7056 clear (boro-silicate) glass for high optical transmission. The use of a glass output window as compared to a fiber optic transmission plate which is the typical output window for military applications, improves both the optical throughput (90% v. 60% transmission) and the optical resolution of the image (20 to 25% better than fiber optic technology). Prior to applying phosphor screen 14 to output window 15, the entire window is baked (at −700° C.) in a reducing hydrogen-filled oven for several hours. Metallic oxides in the surface of the glass react with the hydrogen to blacken the entire outer surface layer. Then both top and bottom surfaces, through which light must pass, are ground and polished to remove the dark surface layers. This leaves the surface of the sides blackened to prevent reflected interior light (referred to as "veiling glare") from distorting the output image from the phosphor screen 14. After the dark firing process is completed, the phosphor screen 14 is made by carefully depositing a Zn,CdS phosphor coating on the inner surface of the glass of from 1 to 3 microns in thickness,. (Other phosphors and output screen deposition techniques may be used.) The phosphor coating should be applied so that the MCP output surface and phosphor screen 14 are aligned in essentially the same longitudinal column. Similar to a television screen, an aluminum metalized conductor −1200 Å thick (not shown in FIG. 1) may be evaporated on the entire inner surface of glass window 15 including the phosphor screen 14. The energized electrons have such a high velocity that they easily penetrate the layer of aluminum to strike the phosphor. Any light directed back to MCP 13 is reflected back by the layer of aluminum. The aluminum layer also serves to conduct the output voltage from feedthrough electrode 25 to energize phosphor screen 14.

MCP 13 is a two-dimensional circular array of hollow glass fibers (each approximately 6 to 12 microns in diameter—nominally 9 microns) fused together into a thin plate approximately 0.016" (0.406 mm) (0.010" to 0.020") thick. Prior to assembly, a thin film of Nichrome metal alloy is evaporated on both sides of MCP 13 as electrodes to permit application of a separate electrical potential to each side of MCP 13 and to help focus the exiting electrons for better image resolution. (Standard microchannel plates are commercially available, Galileo Electro-Optics or Intevac, Inc., of Sturbridge, Massachusetts and Santa Clara, Calif., respectively,) For a preferred construction which is particularly useful when high gain is required, there is incorporated herein by reference the previously filed commonly owned U.S. application to Aebi and Costello. Ser. No. 7/724,041 filed on Jul. 1, 1991 and entitled "Feedback Limited Microchannel Plate Apparatus and Method". After the Nichrome alloy is applied, a thin film of SiO or $Al_2O_3$−100 Å thick (50 Å to 150 Å ) is evaporated over the MCP on the surface that is to face photocathode 12. During the normal operation of MCP 13, the SiO thin film membrane prevents gas molecules and positive ions from penetrating through the tiny holes in the MCP while allowing photoelectrons to pass through. Such a barrier is a fairly common technique used by manufacturers of MCPs to prevent poisoning of the sensitive photocathode 12. Upon assembly of the tube, MCP 13 is properly position by its fit within housing 16.

As is discussed in the aforemention application (Ser. No. 07/724,041) the MCP output advantageously is given a much thicker metallization layer of Aluminum than would otherwise be thought to be necessary to cause constriction in the individual channels of the microchannels. Such a layer reduces the number of X-ray photons which can reenter the MCP channels and strike the photocathode. This design reduces noise producing feedback in the image intensifier. The resulting MCP tube has a much lower noise factor than a tube without such a metallization layer. It is also believed that this constriction helps focus the exiting electrons on the phosphor screen 14.

Photocathode 12, like phosphor screen 14, is bonded to the glass prior to assembly of the tube by depositing a 1 micron layer (0.5 to 2 microns) of AlGaAs on the inner surface of the input glass window 11. Then a 2 micron layer (0.5 to 3 microns) of Zinc-doped GaAs is deposited over the initial layer of AlGaAs. (In the image intensifier tube industry, GaAs used as a photocathode together with a microchannel plate in image tubes results in the tube being classified as a Gen III tube.) Finally the GaAs surface is activated in by exposure to Cesium and Oxygen atoms. The resulting GaAs-/AlGaAs photocathode structure has a very high photosensitivity.

Another improvement to image intensifier tubes in accordance with this invention is the use of what is here termed a "cathode cork" 34 which is, in the preferred embodiment, a ceramic sealing ring providing a further vacuum seal between photocathode 12 and MCP 13. Cathode cork 34 is press fit within housing 16 and colocated between input window 11 at the outer edge, as shown in FIG. 1, of photocathode 12 and MCP 13. One purpose of the cathode cork 34 is to divide the tube interior into two separate chambers. It thus provides an additional sealing barrier to gas molecules or positive ions which may leak through housing 16 or which may be generated by the accelerated electron flow in the gap between phosphor screen 14 and MCP 13. By trapping such unwanted particles on the output side of MCP 13, titanium getter 31 is more likely to precipitate out such particles on the inner wall of housing 16. Getter 31 connects to a feedthrough electrode 32 and is spot-welded into position in final assembly. Cathode cork 34 is held in place relative to housing 16 with a metallic retainer flange 35 which also serves to conduct a potential at electrode 27 to the input side surface of MCP 13. Retainer flange 35 is brazed onto cathode cork 34 prior to insertion into housing 16. The other purpose of cathode cork 34 is to precisely locate and position MCP 13 relative to input window 11. The cathode cork 34 acts as a spacer between shelf 39 on input window 11 and MCP 13, and thus directly controls the very important gap dimension [0.01" (0.254 mm)] between MCP 13 and photocathode 12. The output side of MCP 13 is kept at −800 volts by electrode 26 and spring washer 33, Spring 33 holds MCP 13 in a secure position relative to housing 16. Spring 33 rests between a molded flange inside housing 16 and MCP 13.

Another novel feature of this invention is the indium sealing technique which is the final sealing step in assembling the image tube 10. This feature eliminates frit sealing of the input or output windows which would otherwise be required. However, in addition to being an improved sealing technique, it also improves the spacing of the components within the tube as will be pointed out. Circular grooves 41 and 42 in windows 15 and 11, respectively, provide a reservoir for the indium for input and output windows 15 and 11. When assembled the indium covered glass mates on the top and bottom surfaces of housing 16. Disposed on each housing surface is a raised pointed circular flange 44 and 43, shown in FIG. 1 in cross section as the upper portion of a pointed triangle. Each circular flange 44 and 43 is a molded part of the ceramic housing and advantageously disposed on the housing surface so that when the glass windows are put in place, flanges 44 and 43 interface the center of grooves 41 and 42 respectively. Upon final assembly, the end of flanges 44 and 43 protrudes into the ring of indium to contact the glass under the indium. In other words the output window 15 rests upon circular flange 44 and input window 11 rests upon circular flange 43. This precisely locates the position of the input and output windows 15 and 11 relative to the housing body 16, and also accurately positions the phosphor screen 14 relative to the photocathode 12. This sealing technique also provides a higher reliability seal of windows 11 and 15 with housing 16 because of the shearing action when the flanges are pushed into the indium.

To improve the adhesion of the indium with pointed flanges 44 and 43, a layer of molybdenum-manganese is plated to the entire ceramic flange surface. Then a layer of nickle is plated over the molybdenum-manganese prior to assembly with the glass windows. As a practical matter to improve the adhesion between the glass and the indium, chrome and silver are co-evaporated in grooves 41 and 42 prior to filling with indium. In the final stage of assembly, a ring of indium is placed in each groove 41 and 43 and melted in a vacuum oven. After the indium cools all of the components are assembled (in a vacuum assembly station) in the housing, and windows 11 and 15 are pressed into the housing causing pointed flanges 44 and 43 to penetrate the indium rings thereby sealing the image tube.

The ceramic housing which has been used with this image tube is 97% Alumina and is typical of ceramics used in microwave tubes. It may be purchased from many manufacturers including Wefgo in San Carlos, Calif. Other ceramics that have been used in tube manufacturing may be used for this purpose.

Figure 2:
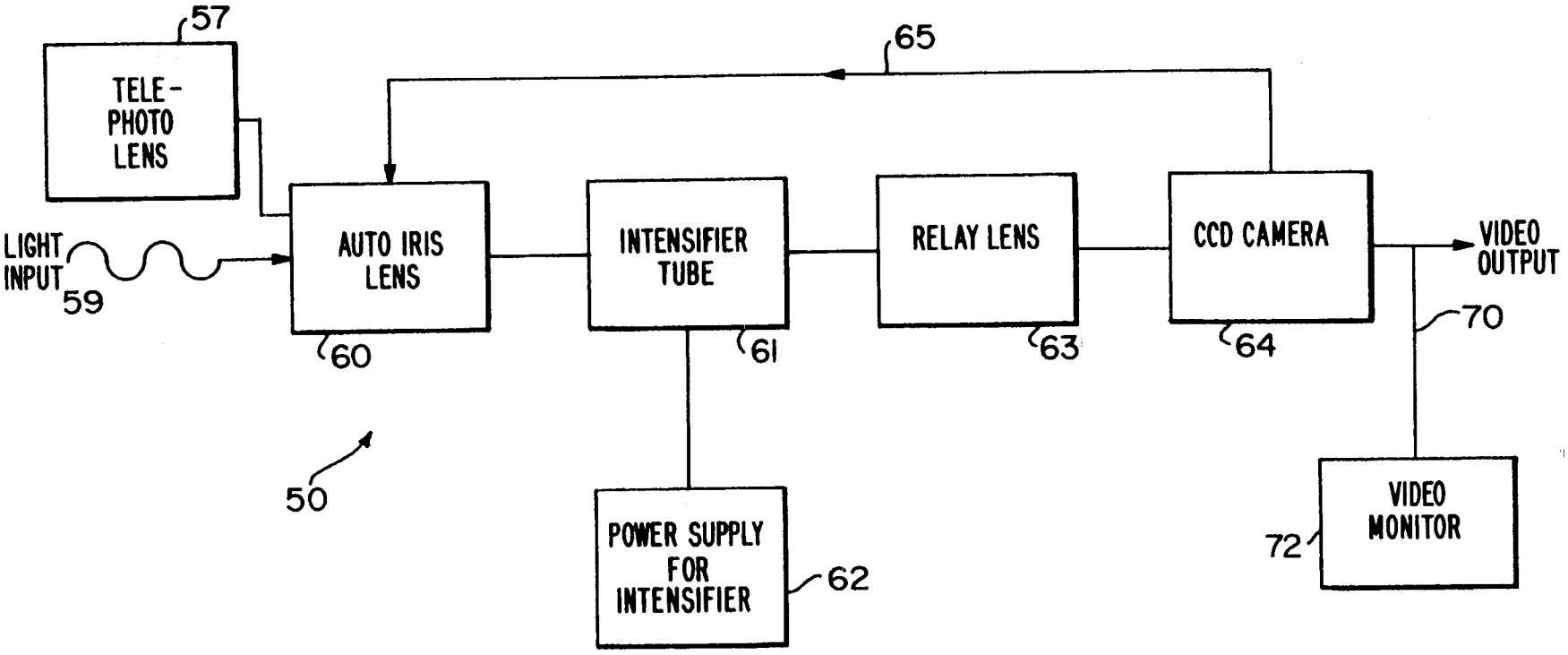
FIG. 2 is a block diagram representation of a video camera system for use in a low-cost closed circuit TV system for which the tubes of this invention are particularly suitable.

To appreciate the utility of the preferred embodiment of the image intensifier tube, consider the system shown in FIG. 2. FIG. 2 shows a block diagram of a video camera system 50 suitable for use in low-cost closed circuit TV system capable of operating under all environmental lighting conditions without additional external illumination. Light image 59 enters through camera system 50 through an iris camera objective lens assembly 60. Changes in the iris control the amount of light allowed to pass to image intensifier tube 61, e.g., of the type shown in FIG. 1. In FIG. 2 iris lens 60 is designated as an automatically controlled iris lens but as will be readily understood, although an automatic lens simplifies operation, it also increases costs and thus in some applications the automatic adjustment feature may be dispensed with. Power supply 62 is a standard high-voltage power supply for supplying proper voltages to tube 61. The output of the intensifier tube is optically focussed by relay lens 63 on to the focal plane of a camera 64. Again although the camera is designated as a CCD, various cameras may be used without departing from the scope of this invention. A feedback signal proportional to the intensity of the light into camera 64, is applied through feedback line 65 to control the input of auto-iris lens assembly 60. An output image is fed by lead 70 to a video monitor 72 and may also be fed to another monitor or other form of storage.

A principal advantage of the system depicted in FIG. 2 is the modular approach taken. By using components that can be easily coupled together, such as by means of screw-on interface couplings, initial fabrication costs and replacement costs can be dramatically reduced. The design choice of a glass output window on intensifier tube 61 and a relay lens 63 to focus the output on to the input of camera 64, permits all of the components to be readily coupled together or uncoupled for replacement of the tube or camera. Prior systems coupled image intensifier tubes directly to the CCD of camera 64 via a fiber optic image conduit that was bonded and sealed in a vacuum to the CCD camera input. Not only is this prior art (CCD wafer-to-fiber optic bundle) interface expensive to make, it is impossible for a customer-/user to replace the camera 64 or the intensifier tube 61 if something goes wrong with either component without replacing the entire system. The system depicted in FIG. 2 is not so limited. However, it is recognized that, even though the glass output window has about one-half the throughput loss of the fiber optic equivalent and a better optical resolution capability, much of the light exiting the phosphor screen of intensifier tube 61 is lost and cannot be focused onto the CCD camera input. Therefore, to have approximately the same optical performance as a totally sealed system, one can use an intensifier tube that has high gain and a high signal-to-noise figure. Notwithstanding this caveat, the video camera system 50 is a lower cost alternative to the prior art systems for the reasons mentioned.

While there has been shown and described a preferred arrangement for an image intensifier tube structure with an improved technique for sealing the tube and its elements with input and output glass windows for improved light transmission in accordance with the invention, it will be appreciated that the invention is not limited to the specifics described. Instead it is intended to cover this invention, including modifications, variations, or equivalent arrangements within the scope of the attached claims.

What is claimed is:

1. An image intensifier tube comprising:

a generally tubular housing capable of providing a hermetic seal;

a glass input window for receiving and transmitting incident light;

a photocathode bonded to said input window for generating photoelectrons in response to light transmitted through said input window to said photocathode;

a microchannel plate spaced apart from said photocathode for amplifying photoelectrons transmitted thereto;

a glass output window spaced from said microchannel plate;

a phosphor screen spaced apart from said microchannel plate and disposed on said glass output window to create a light image output in response to said intensified photoelectrons;

said glass output window for sealing said tube and transmitting said amplified lightimage from said phosphor screen thereon;

said input and output windows being vacuum sealed within said housing by a ring of indium that contacts at least a portion of the interface between each of said windows and said housing, said housing having a pair of raised pointed flanges each positioned along the inner housing surface interfacing said windows, and each being adapted to protrude into the adjacent ring of indium for creating a vacuum seal between said input and output windows and the tube body.

2. An image intensifier tube as defined in claim 1 further comprising:

means for providing a further vacuum seal between said photocathode and said housing comprising a solid ceramic sealing ring press fit within said housing and colocated between said input window at the outer edge of said photocathode and said microchannel plate.

3. An image intensifier tube as defined in claim 2 wherein said pair of pointed flanges has a layer of molybdenum-manganese plated to the entire ceramic flange interface surface and a layer of nickel over said molybdenum-manganese layer for improving the adhesion between said indium and said pointed flanges.

4. An image intensifier tube as defined in claim 3 wherein said photocathode further comprises a layer of AlGaAs deposited on the inner surface of said input glass window and a second layer of zinc-doped GaAs deposited over said layer of AlGaAs.

5. An image intensifier tube as defined in claim 4 wherein said tubular housing further comprises a ceramic body.

6. An image intensifier tube as defined in claim 2 wherein said sealing ring further comprises a ceramic material.

7. An image intensifier tube as defined in claim 6 wherein each of said rings of indium contact the entire portion of the interface between each of said windows and said housing.

8. An image intensifier tube as defined in claim 7 wherein said input and output windows further include circular grooves for providing a reservoir for said indium.

9. An image intensifier tube as defined in claim 8 wherein said circular grooves in said input and output windows include a co-evaporated layer of chrome and silver therein for improving the adhesion between said glass windows and said indium.

10. An image intensifier tube as defined in claim 9 wherein said microchannel plate on the output side includes a thin film layer of Aluminum metalization to reduce feedback.

11. An image intensifier tube as defined in claim 10 wherein said solid glass output window includes blackened side portions to prevent light emanating from said phosphor screen from reflecting off said side portions of said output window.

12. An image intensifier tube comprising:

a generally tubular housing capable of providing a hermetic seal;

a solid glass input window for receiving and transmitting incident light;

a photocathode bonded to said input window for generating photoelectrons in response to light transmitted through said input window and striking said photocathode;

a microchannel plate spaced apart from said photocathode and for receiving and for intensifying received photoelectrons;

a phosphor screen spaced apart from said microchannel plate, said phosphor screen being responsive to said intensified photoelectrons from said microchannel plate and generating amplified light in response to said intensified photoelectrons;

a solid glass output window spaced from said microchannel plate for receiving and transmitting said amplified light, said phosphor screen being bonded to said output window at the surface adjacent to said microchannel plate; and a solid sealing ring for providing a vacuum seal between said photocathode and said housing, said sealing ring positioned within said housing and colocated between said input window at the outer edge of said photocathode and said microchannel plate.

13. An image intensifier tube as defined in claim 12 wherein said microchannel plate includes a thin film layer of Aluminum metalization sufficient to cause an overall constriction in the individual channel output of to reduce feedback.

14. An image intensifier tube as defined in claim 12 wherein said solid sealing ring is press fit within said housing.

15. An image intensifier tube as defined in claim 14 wherein said photocathode further comprises a layer of AlGaAs deposited on the inner surface of said input glass window and a second layer of zinc-doped GaAs deposited over said layer of AlGaAs.

16. An image intensifier tube as defined in claim 15 wherein said tubular housing comprises a ceramic body.

17. An image intensifier tube as defined in claim 16 wherein said solid sealing ring further comprises a ceramic body.

18. An image intensifier tube as defined in claim 17 wherein said solid glass output window is blackened at the side portions of to prevent anti veiling glare in connection with the image generated at said output window.

19. An image intensifier for a CCTV camera system capable of operating under all environmental lighting conditions without external illumination, said image intensifier tube comprising:

a solid glass input window for receiving and transmitting incident light;

a photocathode bonded to said input window for generating photoelectrons in response to light transmitted through said input window and striking said photocathode;

a microchannel plate spaced apart from said photocathode and for receiving and for intensifying received photoelectrons;

a phosphor screen spaced apart from said microchannel plate, said phosphor screen being responsive to said intensified photoelectrons from said microchannel plate and generating amplified light in response to said intensified photoelectrons; and a solid glass output window spaced from said microchannel plate for receiving and transmitting said amplified light, said glass output window being processed in a hydrogen gas reducing oven to blacken at least the side portions of said output window facing said tubular housing to prevent light emanating from said phosphor screen from reflecting off said side portions of said output window;

said phosphor screen being bonded to said output window at the surface adjacent to said microchannel plate; and, a solid sealing ring for providing a vacuum seal between said photocathode and said housing, said sealing ring positioned within said housing and colocated between said input window at the outer edge of said photocathode and said microchannel plate

* * * * *